US007503371B2

(12) United States Patent
Lee

(10) Patent No.: US 7,503,371 B2
(45) Date of Patent: Mar. 17, 2009

(54) COVERED SLAT AND METHOD OF MAKING

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 155 days.

(21) Appl. No.: 11/529,877

(22) Filed: Sep. 29, 2006

(65) Prior Publication Data

US 2008/0078512 A1 Apr. 3, 2008

(51) Int. Cl.
*E06B 3/06* (2006.01)

(52) U.S. Cl. ..... 160/236

(58) Field of Classification Search ..... 160/236, 160/84.01

See application file for complete search history.

(56) References Cited

U.S. PATENT DOCUMENTS 4,884,615 A * 12/1989 Hsu ..... 160/236
5,141,042 A * 8/1992 Schwaegerle ..... 160/236
6,302,183 B1 * 10/2001 Judkins et al. ..... 160/178.1 R
2006/0021719 A1 * 2/2006 Chu ..... 160/236

* cited by examiner

*Primary Examiner*—Blair M. Johnson
(74) *Attorney, Agent, or Firm*—Curtis L. Harrington; Kathy E. Harrington; Harrington & Harrington

(57) ABSTRACT

A finished slat for a window covering includes both the structures and process for producing covered slats. A skeletal structure optimally constructed from a material such as wood or plastic, manufactured to a thickness which is much less than that of conventional slats, yet which is strong enough to support both the skeletal structure and a decorative covering and is rigid enough to avoid warping or sagging over time. The decorative covering may be made from a wide variety of materials, thus creating an infinite range of decorating possibilities; further, the covering may be embellished with artwork or trim according to the tastes of the user. The covering may be closed together around the skeletal structure using any of a variety of techniques, such as heat welding, glue, ultrasonic bonding, stitching, or any combination thereof.

9 Claims, 4 Drawing Sheets

COVERED SLAT AND METHOD OF MAKING

FIELD OF THE INVENTION

The present invention relates to a slat, such as that typically found in horizontal (i.e., Venetian) or vertical blinds, which is constructed from a material that is thin and lightweight, yet strong enough to support both the weight of its own skeletal structures and a that of a decorative covering enclosing its skeletal structures to achieve a sophisticated window treatment which is sturdy, economical, functionally efficient, and aesthetically pleasing to a wide range of decorating tastes.

BACKGROUND OF THE INVENTION

Typically, where louvered window coverings, such as horizontal or vertical blinds, are used for decorative purposes and for controlling the transmission of light through a window, and especially where it is preferable to achieve a sophisticated aesthetic, the selection of affordable window coverings is severely limited.

It is most often the case that the higher-end louvered window treatments utilize thick, heavy slats which are constructed either from solid wood at least 3 mm thick or from an equally thick, equally dense and equally expensive composite manufactured to look and feel like genuine wood. However, using genuine wood slats can be prohibitively expensive because of the high costs of stain-grade wood, particularly in applications where multiple window treatments are necessary. Furthermore, costs can be compounded where windows are not a standard size and customization is required. Composite materials fashioned to look like genuine wood often present similar problems in terms of expense. Unfortunately, plantation shutters and other similarly rich-looking louvered alternatives are rarely a satisfactory substitute from an economic perspective because the grade and thickness of wood necessary to construct those kinds of window coverings still results in high manufacturing costs which must be passed along to the consumer. Of course, where an application requires vertical blinds, an owner currently has few if any alternatives to the more costly wood and synthetic wood-look blinds.

Another common problem with the use of conventional high-end louvered window coverings which utilize thick and heavy wood or wood-look slats is that a window treatment spanning even a standard or longer width window may begin to warp and sag over time, either because of the weight of materials typically used to manufacture the slats or because of the susceptibility of that material to changes in temperature and humidity. Windows that span an appreciable width may require a louvered window covering to be applied in several small sections rather than using a single window treatment which fully spans the width of the window, to avoid sagging and warping. Multiple narrow blind sets used to cover a single window result in a segmented look that is generally undesirable, but there are few alternatives currently available. One available alternative, albeit expensive, is plantation shutters. However, plantation shutters may not always be an option as it is often the case that they can only be used where the window to be treated has ample room for the shutters to be mounted inside the window frame. Even where outside-mount shutters are an option, the support structures between windows are often not wide enough or not substantial enough to support the hardware necessary to mount the shutters. Additionally, because the slats of plantation shutters covers only about 70% of the window (the other 30% of window coverage being attributable to the fixed frame portion of the shutters), the user generally has less control over light transmission than with traditional horizontal or vertical blinds. Finally, although the slats of plantation shutters are usually short enough so that warp and sag may not be issues, the cost of the shutters is still likely to be prohibitively high because large quantities of stain-grade wood are necessary for their manufacture.

Yet another difficulty facing those who desire quality window treatments is that, in homes or offices where construction may be less than optimal, i.e., where the walls may be constructed of an insubstantial material which is unsuitable for mounting a window treatment of any appreciable weight, the selection of available window treatments is further narrowed. There are very few, if any, window treatments currently available which are of a weight light enough to be installed in virtually any setting yet which still imply high quality and good taste.

Finally, manufacturing thick wooden slats for use in conventional louvered window coverings necessarily means consumption of large quantities of wood in the process. In addition to the associated economic costs, using large quantities of wood severely impacts the environment. The environmental effects are even greater where manufacturers may be using wood harvested from older hardwoods, which are extremely difficult if not impossible to renew. Moreover, the high grade of wood required for use in high-end blind systems results in a large volume of waste product attributable to slats that do not make the grade, thus creating more environmental waste as well as generating an additional manufacturing expense that will be passed to the consumer in the price of the window coverings.

What is therefore needed is a slat that is affordable, versatile, and functional, yet which is aesthetically pleasing to even the most discriminating user. The ideal slat will be incorporable into almost all horizontal or vertical louvered blind systems, and will have support structures optimally constructed from materials which may be as thin as 1.5 mm but which are strong enough to provide rigid support for a variety of decorative coverings. As a result, the ideal slat will be lightweight, relatively inexpensive, universally useable, and environmentally conservative.

SUMMARY OF THE INVENTION

The present invention involves both the structures and process for producing covered slats for use in a louvered window covering. The covered slats of the present invention have a skeletal structure which is optimally constructed from materials which are lightweight yet strong enough to support both the skeletal structure itself and any one of a variety of decorative coverings to achieve a sophisticated aesthetic at an affordable cost. The skeletal structure is ideally constructed from a material, such as wood or plastic, manufactured to a thickness which is much less thick (as thin as 1.5 mm), and thus much more lightweight, than the thickness of material used in conventionally available slats (as thick as 3 mm or more), but which retains sufficient rigidity to provide the strength of support necessary to avoid warping or sagging. A wide range of materials, such as vinyl, plastic, or fabric, may be used to cover the skeletal structure, creating an infinite range of decorating possibilities. Furthermore, the covering can be of a material susceptible to the application of embellishments, such as machine-generated artwork, hand-applied artwork, edge-gilding, or trim, further expanding the numerous ways in which the look of the slats can be varied. Once the covering is fitted around the skeletal structure, the edges of the covering may be closed together using any of a variety of different techniques. For example, if the covering is sensitive to heat and/or pressure, such as vinyl or plastic would be, the edges can be crimped or welded together. Otherwise, the edges of the covering can be sewn, glued, or bonded together ultrasonically. Finally, to increase the probability that the edges will stay bonded together over time and variations in temperature, humidity, and ultra-violet exposure, multiple combinations of the aforementioned techniques (for example, sewing in addition to gluing or welding) may be used to close the edges of the covering once it is fitted around the skeletal structure of the slat. Incorporation of the covered slats of the present invention in a louvered window covering will result in a sophisticated window covering which is aesthetically desirable, yet is environmentally conservative, is more economical in terms of both materials and cost, is lighter in weight, and is more universally useable than conventional louvered window coverings.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
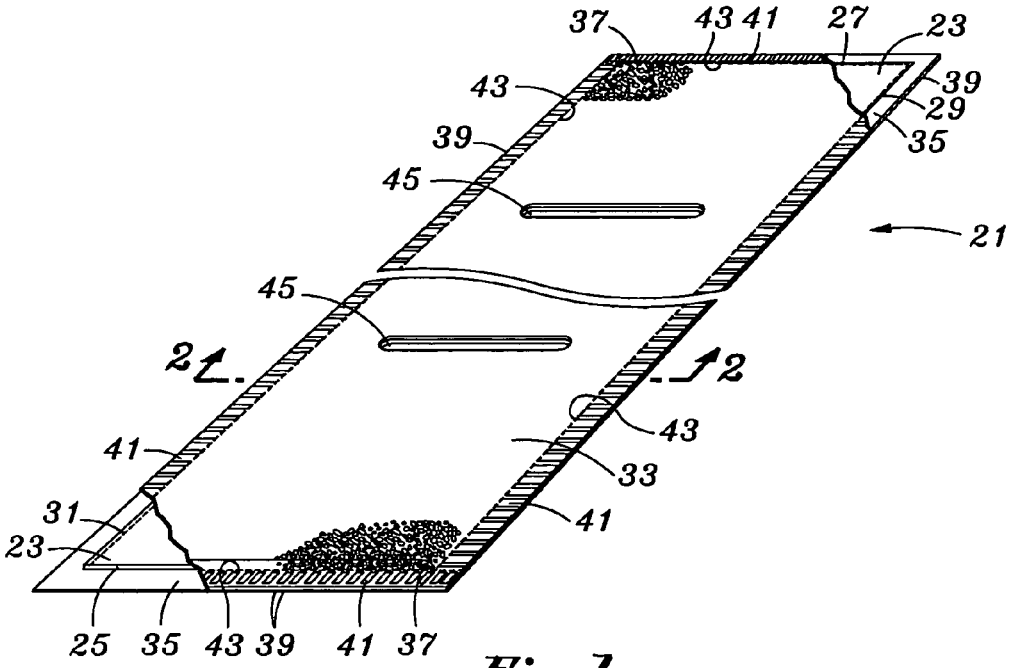
FIG. 1 is a perspective view of a first embodiment of the covered slat of the present invention and includes cutaway views revealing a skeletal slat between two layers of covering which are sealed and sewn together along four edges, and FIG. 1 further illustrates two elongate apertures extending through both layers of covering and through the skeletal slat to accommodate a string, rope, or ladder system such as that used to raise, lower, or adjust a set of blinds.

The description of the covered slat of the present invention is best described with reference first to FIG. 1, which illustrates a first embodiment of the covered slat 21 of the present invention. Covered slat 21 comprises a skeletal structure hereinafter a skeletal slat 23, a portion of its first main surface being seen, and with its second main surface opposite the first main surface not seen in FIG. 1. Skeletal slat 23 has a first end 25, a second end 27 oppositely disposed from first end 25, a first side surface seen as a first side 29, and a side surface seen as a second side 31 oppositely disposed from first side 29. The skeletal slat 23 may be made of wood, fiber, graphite, polypropylene, composite, bamboo, epoxy, fiberglass, metal, polystyrene, and nylon to name a few. The skeletal slat 23 is enclosed by a first layer of covering 33 and a second layer of covering 35. First layer of covering 33 is illustrated as optionally having texturing 37, and both layers of covering 33 and 35 are slightly larger in area than skeletal slat 23 so that sufficient overlap exits on all four sides of skeletal slat 23 for attaching the first layer of covering 33 to the second layer of covering 35 to enclose the skeletal slat 23. The covered slat 21 of FIG. 1 is illustrated as having raw edges 39. Sufficient overlap, areas where both layers of covering 33 and 35 oppose each other beyond the extent of the skeletal slat 23, usually approximates 3 mm-5 mm for raw edges such as those in FIG. 1 and approximately 6 mm-10 mm for finished edges (see description of FIG. 4).

Figure 2:
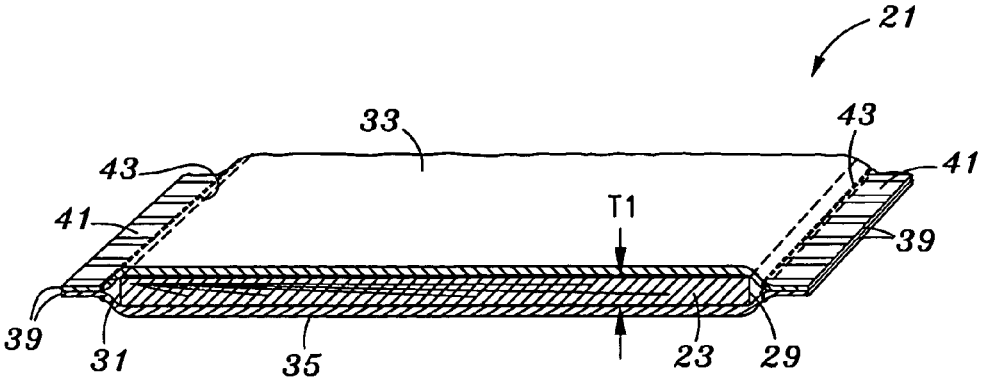
FIG. 2 is a cross-sectional perspective view taken along line 2-2 of FIG. 1 which illustrates in greater detail the placement of the skeletal slat between two layers of covering which are sealed and sewn together.

The two layers of covering 33 and 35 may be sealed together as shown in FIG. 2 to form a seam 41 adjacent first and second ends 25 and 27 and first and second sides 29 and 31 of skeletal slat 23. The two layers of covering 33 and 35 may be additionally sewn together with stitching 43 along the inside edge of seam 41. The covering can be joined together using any number of different techniques. For example, where the covering material is susceptible to heat and pressure, the edges can be heat sealed or welded together as illustrated in FIG. 1. Additionally, the two layers of covering 33 and 35 may be sewn, glued, or ultrasonically bonded together.

The aforementioned techniques can also be used in combination with one another to ensure that the covering remains securely in place around the skeletal structures. For instance, where glue is used to seal the coverings together, sewn reinforcement of the coverings may be helpful in preventing separation of the layers if the glue should dry out and become ineffective because of age, temperature changes, exposure to ultra-violet light, or fluctuations in humidity. Even where the coverings are sealed together with a more reliable technique such as heat sealing, it may still be desirable to use stitching to reinforce the seams (as in FIG. 1) in case any segment of the seam fails to seal.

FIG. 1 further illustrates a pair of elongate apertures 45 which partially transverse the width of the covered slat 21 (the width being generally equivalent to the distance between first side 29 and second side 31 of skeletal slat 23) and which extend through the first layer of covering 33, the skeletal slat 23, and the second layer of covering 35 to accommodate a rope or string lift cord such as that commonly used in louvered blind systems to raise and lower the slats and to adjust the angle of the slats to control light transmission. Note that the apertures 45 can be made smaller depending on the diameter of the string or rope to be passed through them. The apertures 45 are ideally created during the process of manufacturing but may be added after-market as well.

FIG. 2 is a cross-sectional perspective end view along line 2-2 of FIG. 1 which illustrates the covered slat 21 including the skeletal slat 23 between the two layers of covering 33 and 35, the seam 41 and the stitching 43. FIG. 2 more clearly illustrates the thickness T1 of the skeletal slat 23. Optimally, the skeletal slat 23 will be constructed of a material, such as wood, fiber, or plastic, manufactured to a thickness T1 which just allows the skeletal slat to support itself and a given covering without sagging or bending. For wood slats, the optimal thickness T1 in terms of cost and rigidity will be approximately 1.5 mm, but may vary slightly depending on the weight of the coverings 33 and 35 used to enclose the skeletal slat 23.

Figure 3:
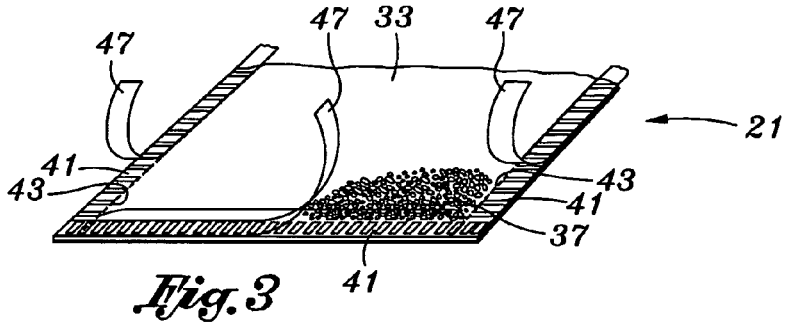
FIG. 3 is a view of one end of the covered slat shown in FIG. 1 and illustrates the application of gold-leaf embellishment on the surface of the covering along its outer edges.

FIG. 3 is a view of one end of the covered slat 21 shown in FIG. 1 and further illustrates the application of gold-leaf 47, or any other metallic or thin material, being applied to the first layer of covering 33 along or adjacent seam 41. The coverings used to enclose the skeletal structure of any embodiment of the covered slat of the present invention can be further enhanced during the manufacturing process by this or any number of other different embellishments to vary their appearance, such as machine-applied or hand-applied artwork or trim, thus creating an infinite number of decorating possibilities.

Figure 4:
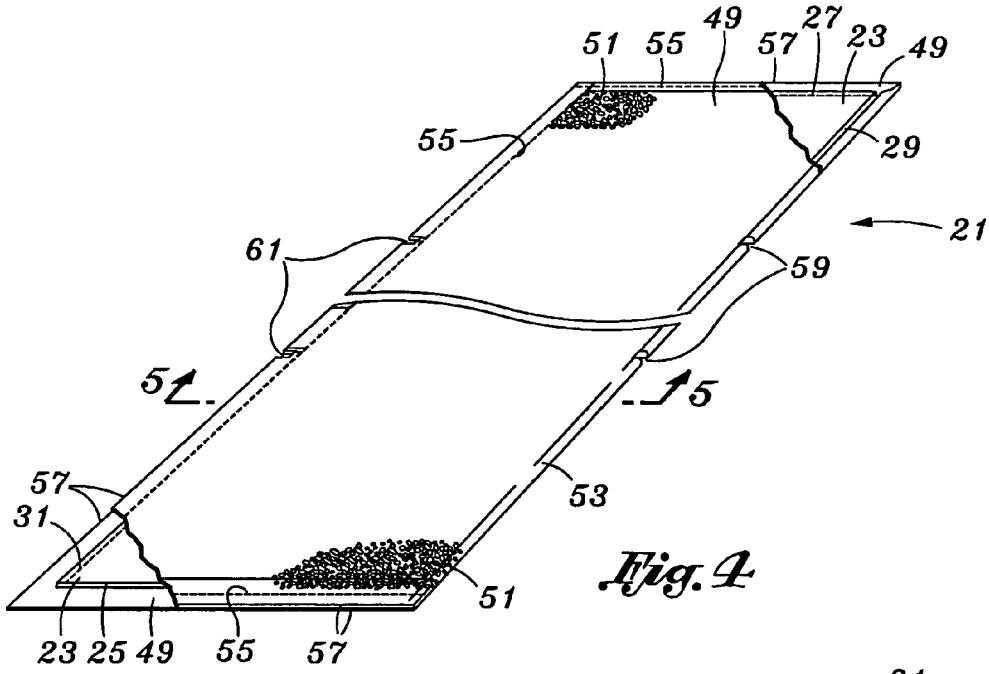
FIG. 4 is perspective view of the first embodiment of the covered slat of the present invention illustrating a different technique used for covering the skeletal slat, and includes cutaway views revealing the placement of the skeletal slat inside a single layer of covering which is folded over the skeletal slat along its length and which is sewn together along three sides, and FIG. 4 further illustrates a pair of notches in the covering on each side of the covered slat to accommodate a string, rope, or ladder system such as those used to raise, lower, and adjust blinds in certain blind systems.

FIG. 4 is perspective view of the first embodiment of the covered slat 21 of the present invention which is covered using a slightly different technique than that illustrated in FIGS. 1-3. FIG. 4 includes cutaway views which reveal the skeletal slat 23 inside a single layer of covering 49 with texturing 51 which is folded over the skeletal slat 23 to form a radius 53 adjacent the first side 29 of the skeletal slat 23. The covering 49 is sewn together with stitching 55 adjacent the first and second ends 25 and 27 and adjacent the second side 31 of skeletal slat 23. Note that when the covering 49 is sewn together using stitching 55, the covering edges 57 distal to stitching 55 may be raw as in FIG. 3 or may be given a more finished look by making a fold in the raw covering edges 57 prior to sewing such that the raw covering edges 57 are turned inward and caught in the stitching 55 leaving turned edges for a more cleanly upholstered look. FIG. 3 also illustrates a first pair of notches 59 carved into covering 49 adjacent the first side 29 of covered slat 21 and a second pair of notches 61 carved into covering 49 on the second side 31 of covered slat 21 to accommodate a vertical set of strings in a ladder cord which supports such as those commonly used to raise, lower, and adjust the slats in louver-type blind systems.

Figure 5:
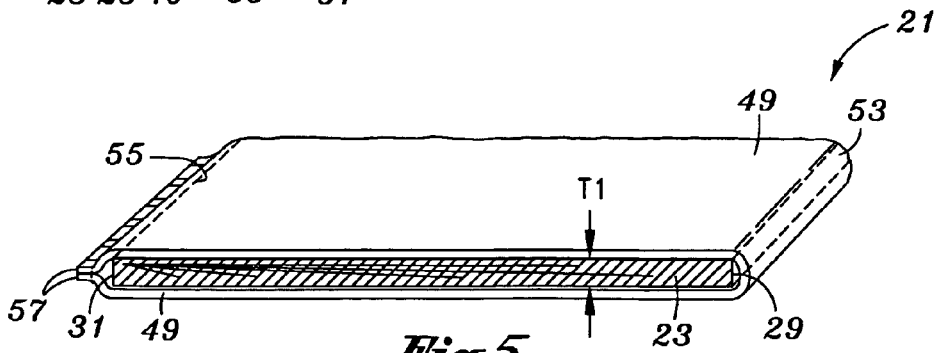
FIG. 5 is a cross-sectional perspective view along line 4-4 of FIG. 3 which illustrates in greater detail the skeletal slat of FIG. 3 enclosed within a single layer of covering having sewn edges.

FIG. 5 is a cross-sectional perspective view along line 5-5 of FIG. 4 which illustrates the skeletal slat 23 enclosed within the single layer of covering 49 and illustrates in greater detail the skeletal slat 23, radius 53 formed by covering 49 adjacent the first side 29 of skeletal slat 23 and stitching 55 adjacent the second side 31 of skeletal slat 23. As in FIG. 2, FIG. 4 clearly illustrates the thickness T1 of skeletal slat 23, which, again, may optimally be around 1.5 mm but which may vary slightly depending on the weight of the covering 49 used to enclose the skeletal slat 23.

Figure 6:
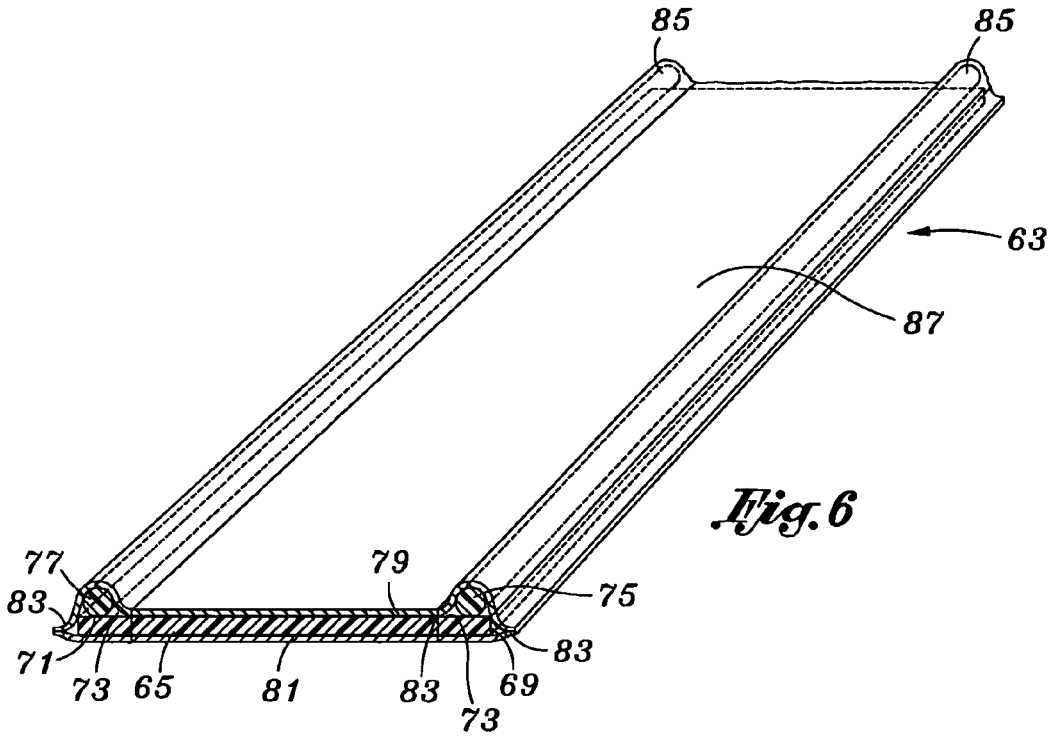
FIG. 6 is a perspective view of the top of a second embodiment of the covered slat of the present invention and includes a cross-sectional view of one end of the covered slat which reveals a skeletal slat and 2 cylindrical rods extending along the top outer edges of the skeletal slat, all of which are between two layers of covering sewn together on four sides such that the ribs and adjacent portions of the skeletal slat are compartmentalized.

FIG. 6 is a cross-sectional perspective view of the top of a further embodiment of the covered slat 63 of the present invention. FIG. 6 illustrates a skeletal slat 65 having a narrow first side 69, a narrow second side 71 oppositely disposed from first side 69, and a top surface 73. FIG. 6 further illustrates a first rod 75 extending along the top surface 73 of the skeletal slat 65 adjacent and parallel to first side 69 of the skeletal slat 65 and a second rod 77 extending along the top surface 73 of the skeletal slat 65 adjacent and parallel to second side 71 of the skeletal slat 65. First and second rods 75 and 77 may preferably constructed of hard plastic in a diameter which is optimally between 2 mm and 2.5 mm for maximum rigidity and weight-bearing capacity as well as minimal breakability and weight. Although first and second rods 75 and 77 are illustrated in FIG. 6 as having a circular cross-sectional shape, they can conceivably be manufactured in a variety of other cross-sectional shapes such as square or triangular. The skeletal slat 65 and rods 75 and 77 are between a top layer of covering 79 and a bottom layer of covering 81. In FIG. 6, the layers of covering 79 and 81 are sewn together with stitching 83 which runs parallel to rods 75 and 77 and which is adjacent each of rods 75 and 77 both medially and laterally. The stitching 83 which is situated medial to rods 75 and 77 extends through skeletal slat 65 so that both rods 75 and 77 are compartmentalized, thus stabilizing the skeletal structures of the covered slat 63 for maximum rigidity and support. The configuration of rods 75 and 77 creates a pair of ridges 85 in the top layer of covering 79 which are approximately the similar in height as the diameter of rods 75 and 77 (2 mm to 2.5 mm). Extending between the pair of ridges 85 is a planar surface 87 formed by the top layer of covering 79 which is in approximately the same plane as top surface 73 of skeletal slat 65.

Figure 7:
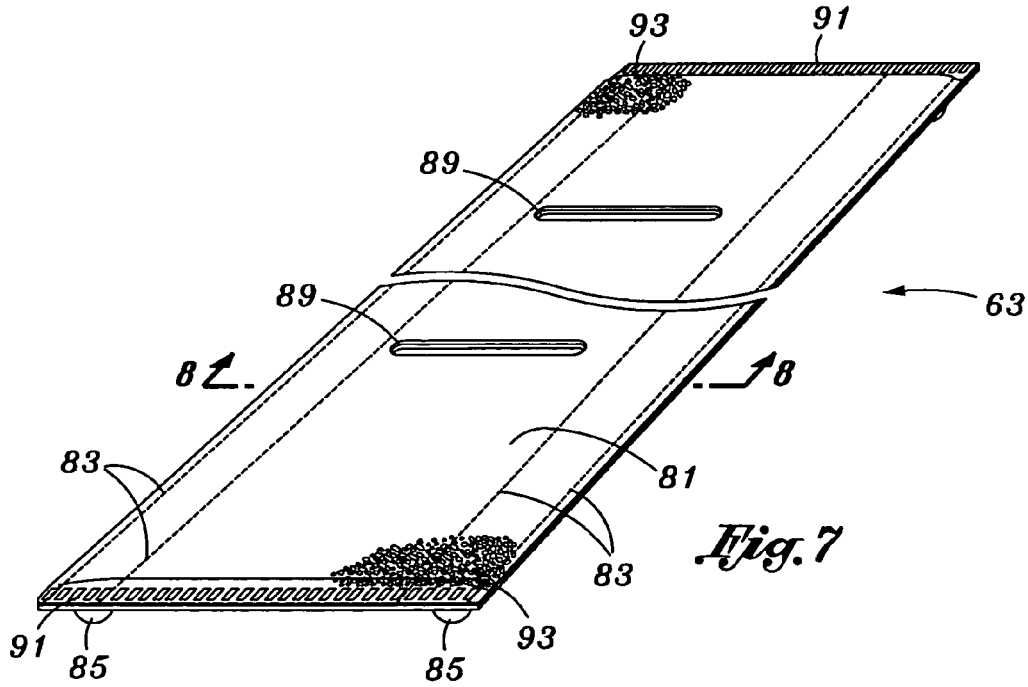
FIG. 7 is a perspective view of the bottom of the second embodiment of the covered slat of the present invention and further illustrates two elongate apertures extending through both layers of covering and through the skeletal slat to accommodate a string system such as that used in a louver type blind system.

FIG. 7 is a perspective view of the bottom of the second embodiment of the covered slat 63 of the present invention which illustrates the covered slat 63 as having a pair of elongate apertures 89 which partially extend over the width of the covered slat 63 (the width being generally equivalent to the distance between first side 69 and second side 71 of skeletal slat 65) and which extend through the top layer of covering 79, the skeletal slat 65 (not illustrated in FIG. 7), and the bottom layer of covering 81 to accommodate a rope or string such as a lift cord that commonly used in louvered blind systems to raise and lower the slats and to adjust the angle of the slats to control light transmission. Note that the pair of apertures 89 can be made significantly smaller depending on the diameter of string or rope to be passed through them. The pair of apertures 89 are ideally created during the process of manufacturing but may be added after-market as well. In FIG. 7, the layers of covering 79 and 81 are illustrated as sealed together adjacent both ends of skeletal slat 65, forming a seam 91, though the coverings 79 and 81 could conceivably be sewn together as well, either in addition to or instead of being sealed. Bottom covering 81 is illustrated in FIG. 7 having texturing 93, but can conceivably be any of an infinite variety of coverings which may or may not be textured. The four rows of stitching 83 are shown as compartmentalizing rods 75 and 77 on the top of the skeletal slat 65 are anchored in the bottom covering 81 as illustrated in FIG. 7.

Figure 8:
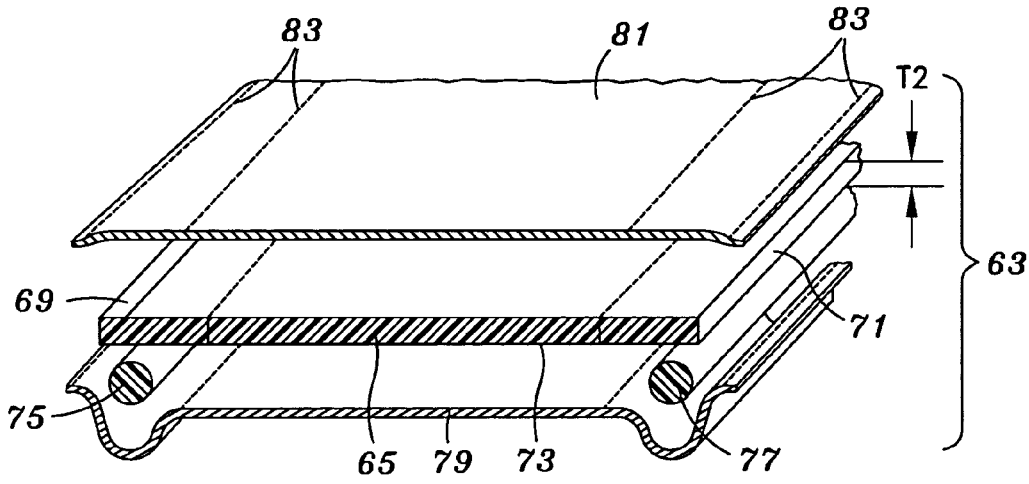
FIG. 8 is an exploded cross-sectional view of the second embodiment of the covered slat taken along line 8-8 of FIG. 7 which more clearly illustrates the skeletal slat and the two rods sewn between two layers of covering; and, FIG. 9 is an exploded cross-sectional view of a third embodiment of the covered slat of the present invention which illustrates a flanged skeletal slat sewn between two layers of covering.

FIG. 8 is an exploded cross-sectional view of the second embodiment of the covered slat 63 taken along line 8-8 of FIG. 7. FIG. 8 more clearly illustrates skeletal slat 65 and rods 75 and 77, all of which are sewn and sealed between the two layers of covering 79 and 81 as described in FIG. 7. The rigidity necessary to support the structures of this embodiment derives mostly from rods 75 and 77; consequently, thickness T2 of the skeletal slat 65 will optimally be between 0.5 mm and 1 mm, somewhat thinner than its wood counterpart since the primary function of the skeletal slat 65 in this embodiment may be to impart shape more than support.

Figure 9:
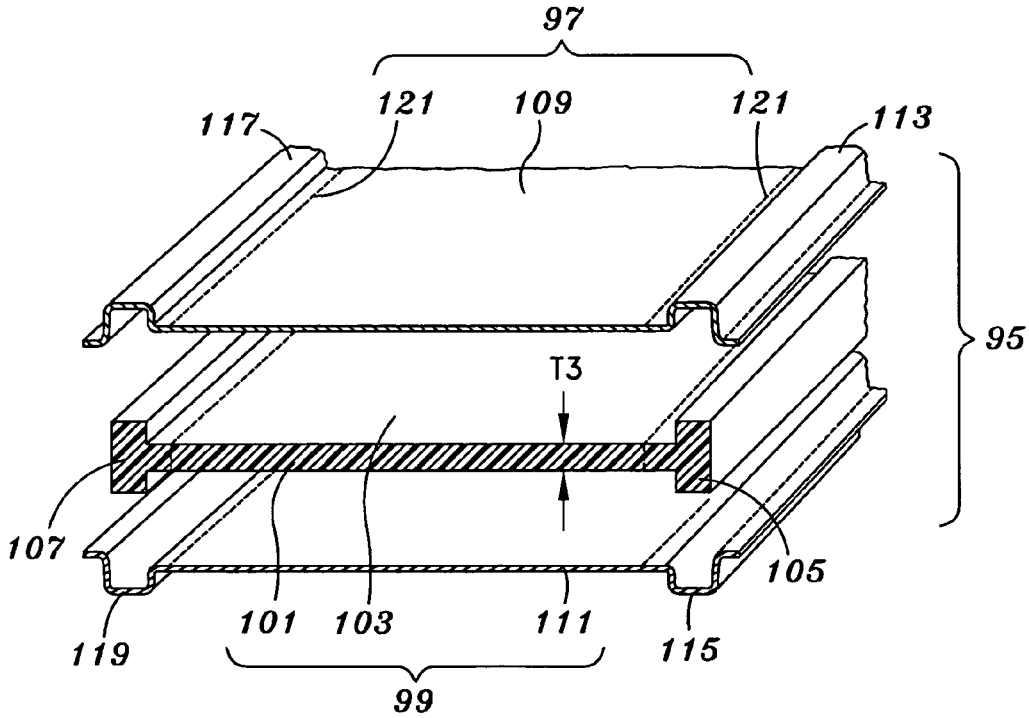

FIG. 9 is an exploded view of a third embodiment of the covered slat 95 of the present invention having a first side 97 and a second side 99 oppositely disposed from first side 97. Covered slat 95 comprises an extruded I-shaped skeletal slat 101 having a planar middle portion 103 which extends between a first rib member 105 and a second rib member 107. Skeletal slat 101 is illustrated between a first layer of covering 109 and a second layer of covering 111. First and second rib members 105 and 107 protrude away from the plane of middle portion 103 on both sides of covered slat 95 such that first rib member 105 forms a first ridge 113 in the first layer of covering 109 and a second ridge 115 in the second layer of covering 111, and second rib member 107 forms a first ridge 117 in the first layer of covering 109 and a second ridge 119 in the second layer of covering 111. Layers of covering 109 and 111 are sewn together with stitching 121 which runs parallel to first and second rib members 105 and 107 and which is adjacent rib members 105 and 107 both medially and laterally. The stitching 121 which is medial to rib members 105 and 107 extends through the middle portion 103 of skeletal slat 101 so that both rib members 105 and 107 are compartmentalized. Rib members 105 and 107 should be approximately the same thickness as rods 75 and 77 in the covered slat 63 of FIGS. 6 through 8, i.e., 2 mm to 2.5 mm, in order to provide rigid support sufficient to avoid warping or bending. Similarly, the thickness T3 of the skeletal slat 101 will be between 2 mm and 2.5 mm, slightly thicker than the skeletal slat 65 of the second embodiment of covered slat 63 described in FIGS. 6 through 8. Although rib members 105 and 107 are illustrated in FIG. 9 as being generally rectangular in shape, rib members 105 and 107 can conceivably be any of a number of different shapes, such as spherical or triangular.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A slat for a window covering comprising:

a substantially planar main skeletal structure having a first main surface oppositely disposed from a second main surface, a first side surface extending between said first and second main surfaces and oppositely disposed from a second side surface extending between said first and second main surfaces, a first end surface extending between said first and second main surfaces and oppositely disposed from a second end surface extending between said first and second surfaces;

a first reinforcing member adjacent and parallel to said first side surface of said main skeletal structure;

a second reinforcing member adjacent and parallel to said second side surface of said main skeletal structure; and a decorative covering, said decorative covering having a finished first side, said finished first side opposite a second side, and wherein said decorative covering envelopes said main skeletal structure and said first and second reinforcing members such that said first finished side faces outward and away from said main skeletal structure and said first and second reinforcing members and said second side faces inward toward said main skeletal structure and said first and second reinforcing members, and wherein said decorative covering is attached to said main skeletal structure by stitching which extends through said decorative covering and through said main skeletal structure such that said first reinforcing member is restrained against said first main surface of said main skeletal structure adjacent said first side surface of said main skeletal structure and said second reinforcing member is restrained against said first main surface of said main skeletal structure adjacent said second side surface of said main skeletal structure, such that the shape of said first and second reinforcing members is at least partially expressed through said decorative covering, and such that said decorative covering extends beyond at least three of said two sides and said two ends of said main skeletal structure.

2. The slat recited in claim 1 and further comprising a first pair of notches in said decorative covering adjacent said first side surface of said main skeletal structure and a second pair of notches in said decorative covering adjacent said second side surface of said main skeletal structure for accommodating strings or ropes such as those commonly used to adjust louvered window treatments.

3. The slat recited in claim 1 wherein said decorative covering is a single layer of material, said single layer of material folded over the length of said main skeletal structure such that said single layer of material forms a radius along the longitudinal length of said first side surface of said main skeletal structure, a top flap adjacent said first main surface of said main skeletal structure and a bottom flap adjacent said second main surface of said main skeletal structure, and wherein said second side of said top flap lies adjacent said first main surface of said main skeletal structure and said second side of said bottom flap lies adjacent said second surface of said main skeletal structure, said top and bottom flaps having three free edges, and wherein said top and bottom flaps are equal in area such that said three free edges of said top flap are coextensive with said three free edges of said bottom flap.

4. The slat recited in claim 1 wherein said main skeletal structure is at least one of wood, fiber, graphite, polypropylene, composite, bamboo, epoxy, fiberglass, metal, polystyrene, and nylon.

5. The slat recited in claim 1 and further comprising a pair of apertures extending through said decorative covering and said main skeletal structure for accommodating strings or ropes such as commonly used to control louvered window treatments.

6. The slat recited in claim 1 wherein said decorative covering comprises a first layer of material and a second layer of material, and wherein said second side of said first layer of material lies adjacent said first main surface of said main skeletal structure and said second side of said second layer of material lies adjacent said second main surface of said main skeletal structure, and wherein said first and second layers of material overlap the area of said main skeletal structure.

7. A method for covering a slat comprising the steps of:

Sizing and cutting at least one layer of material, said material having a finished first side, said finished first side opposite a second side, to an area which, when fitted around a given substantially planar main skeletal structure having a first main surface oppositely disposed from a second main surface, a first reinforcing member adjacent and parallel to said first main surface of said main skeletal structure, and a second reinforcing member adjacent and parallel to said first main surface of said main skeletal structure, will overlap the area of said main skeletal structure on at least three sides;

Fitting said at least one layer of material around said main skeletal structure to form a top flap and a bottom flap such that said finished first side of said at least one layer of material faces away from said main skeletal structure;

Adjusting said top and bottom flaps so that they are congruent and coextensive with one another along at least 3 sides of said main skeletal structure and so that they overlap said main skeletal structure;

Stitching said top and bottom flaps together and through said main skeletal structure along said at least 2 longitudinal sides of said main skeletal structure such that said main skeletal structure and said first and second reinforcing members are fully enclosed within said at least one layer of material such that the shape of said first and second reinforcing members is expressed through said decorative covering.

8. The method recited in claim 7 wherein said at least one layer of material is a single layer, and wherein the step of fitting said single layer around said main skeletal structure includes folding said single layer over the length of one longitudinal side of said main skeletal structure such that said single layer forms a radius along said length of said one longitudinal side of said main skeletal structure between said top flap and said bottom flap.

9. The method recited in claim 7 and further comprising the step of at least one of cutting a pair of notches in said decorative covering adjacent a first longitudinal side of said main skeletal structure and cutting a pair of apertures through said covering and through said top and bottom flaps to accommodate strings and ropes commonly used to adjust louvered window treatments.

* * * * *